United States Patent [19]

Watanabe et al.

[11] Patent Number: 4,723,888

[45] Date of Patent: Feb. 9, 1988

[54] PUMP APPARATUS

[75] Inventors: Kiyohiko Watanabe, Chiryu; Kazuma Matsui, Toyohashi; Yoshiyuki Hattori, Toyoake; Toshihiro Takei, Kariya; Toshiaki Nakamura, Anjo; Shunsaku Ohnishi, Toyota, all of Japan

[73] Assignee: Nippondenso Co., Ltd., Kariya, Japan

[21] Appl. No.: 369,426

[22] Filed: Apr. 19, 1982

[30] Foreign Application Priority Data

Apr. 22, 1981 [JP] Japan ..... 56-58106[U]

[51] Int. Cl.[4] ..... F04D 5/00

[52] U.S. Cl. ..... 415/53 T; 415/98; 415/213 T

[58] Field of Search ..... 415/53 T, 98, 213 T

[56] References Cited

U.S. PATENT DOCUMENTS

| | | | |
|---|---|---|---|
| 1,865,396 | 6/1932 | Claypool | 415/213 T |
| 2,465,625 | 3/1949 | Aue | 415/98 |
| 3,658,444 | 4/1972 | Rhodes et al. | 415/213 T |

FOREIGN PATENT DOCUMENTS

| | | | |
|---|---|---|---|
| 1262489 | 4/1961 | France | 415/53 T |

*Primary Examiner*—Timothy F. Simone
*Assistant Examiner*—Frankie L. Stinson
*Attorney, Agent, or Firm*—Cushman, Darby & Cushman

[57] ABSTRACT

A regenerative pump has a pump housing and a disc-like impeller mounted in the housing so as to be rotated by a motor. The impeller is provided with circumferential rows of radial vane grooves formed in the opposite end faces of the impeller adjacent to the outer periphery thereof. The rows of grooves are surrounded by a circumferential fluid passage which is formed between the impeller and the pump housing and communicated with suction and discharge ports formed in the pump housing and open to the circumferential fluid passage adjacent to the outer peripheral edges of respective end faces of the impeller. Each of the vane grooves has a bottom face which is arcuate as viewed in a radial section of the impeller. The suction port is substantially tangential to the bottom face of each vane groove in the adjacent end face of the impeller at the junction between the groove bottom face and the end face of the impeller.

6 Claims, 4 Drawing Figures

PUMP APPARATUS

BACKGROUND OF THE INVENTION

1. Field of the Invention

The present invention relates to a pump apparatus such as a fuel pump for use in a vehicle to pump fuel from a fuel tank into an internal combustion engine mounted on the vehicle.

2. Description of the Prior Art

In the field of pumps of the class specified above, various types of pumps have been used, such as displacement type pump (for example, roller pump), centrifugal type pump, axial flow type pump and regenerative pump of "open vane type" to be defined later. The displacement type pumps, such as roller pump, are operative to produce a high pressure (from about 2 to about 3 kg $cm^2$) and provide a high efficiency. The pumps of this type, however, must be manufactured with a high precision and are very expensive. The pumps of this type, moreover, produce noise and vibration and, in addition, pulsated discharge pressure. The pumps of axial flow type and the centrifugal pumps are not operative to produce such a high pressure as from 2 to 3 $kg/cm^2$. The regenerative pumps of open vane type are also not operative to produce such a high pressure and, in addition, provide a low efficiency. By the words "open vane type regenerative pump" used in this specification, it is meant to say a regenerative pump in which the bottom face of each of vane grooves formed in one of the end faces of a disc-like impeller intersects with the bottom face of an adjacent vane groove formed in the other end face of the impeller.

SUMMARY OF THE INVENTION

It is an object of the present invention to provide an improved pump apparatus which is operative to produce a high discharge pressure and provide a high efficiency.

It is another object of the present invention to provide an improved regenerative pump of "closed vane type'.

The words "regenerative pump of closed vane type" used herein are intended to mean a regenerative pump in which the bottom face of each of vane grooves formed in one of the end faces of a disc-like impeller does not intersect with the bottom face of an adjacent vane groove formed in the other end face of the impeller.

The pump apparatus according to the present invention comprises a pump means and means drivingly connected to the pump means to drive the same. The pump means comprises a closed vane type regenerative pump and includes a pump housing and an impeller rotatably housed in the pump housing. The impeller has a substantially disc-like shape and is provided with first and second circumferential rows each formed by a plurality of circumferentially spaced radial vane grooves formed in each of the end faces of the impeller adjacent to the outer peripheral surface of the impeller. The pump housing cooperates with the impeller to define a circumferential fluid passage surrounding the circumferential rows of vane grooves. The pump housing is formed therein with suction and discharge ports spaced circumferentially of the impeller and communicated with the circumferential fluid passage. The suction port is disposed adjacent to the first row of vane grooves. The pump means further includes means disposed in the circumferential fluid passage between the suction and discharge ports to provide a circumferential seal therebetween. Each of the vane grooves is open partly in an associated end face of the impeller and partly in the outer peripheral surface thereof and has a bottom face which is substantially arcuate as viewed in a radial section of the impeller and extends between the associated end face of the impeller and the outer peripheral surface thereof. The suction port has an inner end open to the circumferential fluid passage adjacent to one of the end faces of the impeller and is substantially tangential to the arcuate bottom face of each of the vane grooves of the first row at the junction between the arcuate vane groove bottom face and the one end face of the impeller.

Preferably, the pump housing may include an integral portion extending into the circumferential fluid passage to provide the circumferential seal.

With the structure and arrangement discussed above, the pump apparatus according to the present invention is operative to produce a high discharge pressure of from about 2 to about 3 $kg/cm^2$ with low level of noise, low level of vibration and low level of pulsation of discharge pressure and provides a high efficiency. In addition, the tangential orientation of the suction port with respect to the arcuate bottom faces of vane grooves advantageously facilitates a smooth flow of fluid into the circumferential fluid passage in the pump without disturbing the swirls produced in the circumferential fluid passage by the impeller, reduces the resistance of the pump to the incoming flow of fluid, minimizes the impact shock applied to the impeller by the incoming flow of fluid and improves the pump performance.

The above and other objects, featues and advantages of the present invention will be made more apparent by the following description with reference to the accompanying drawings.

DESCRIPTION OF PREFERRED EMBODIMENT

Figure 1:
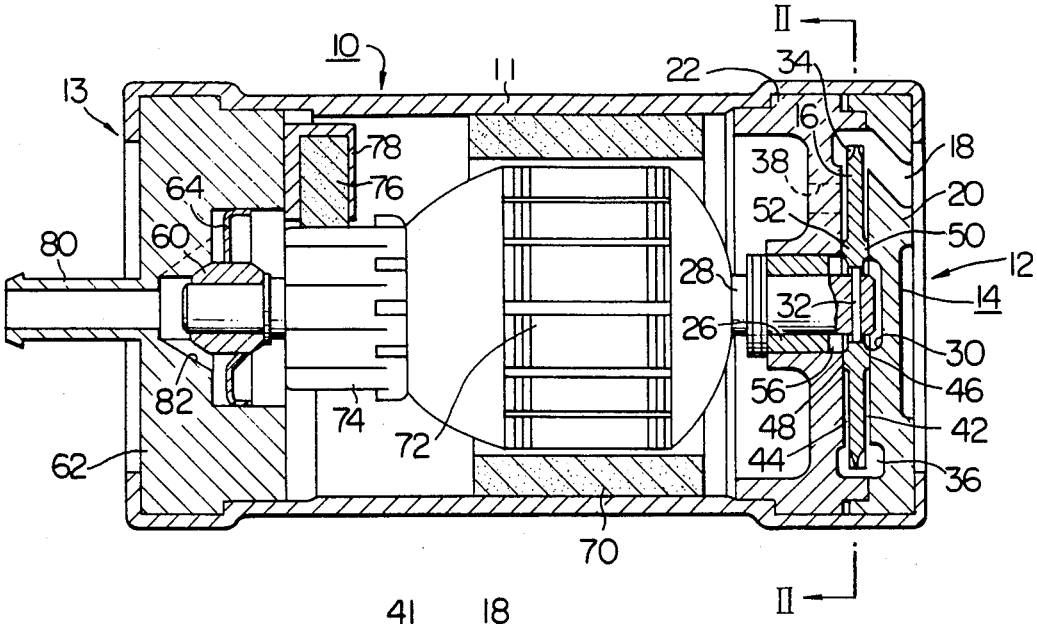
FIG. 1 is an axial sectional view of an electrically operated fuel pump embodying the present invention.
Figure 2:
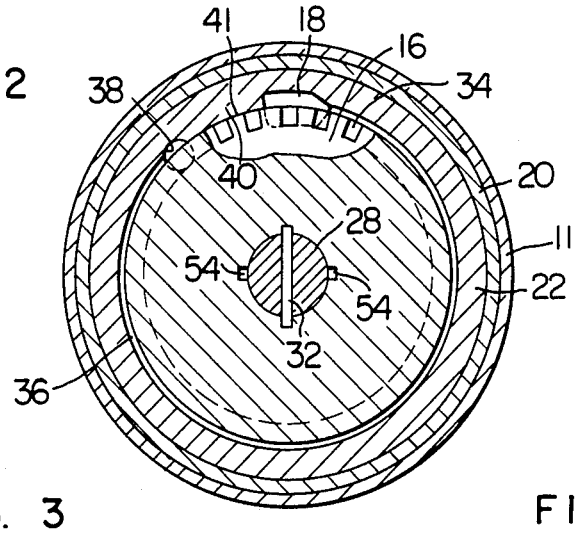
FIG. 2 is a cross-sectional view of the fuel pump shown in FIG. 1 taken substantially along line II—II in FIG. 1.

Referring to FIGS. 1 and 2, an electrically operatred fuel pump apparatus is generally designated by 10 and includes a casing 11 which houses therein a pump 12 and an electric motor 13. The pump 12 comprises a pump housing 14 and a disc-like impeller 16 rotatably mounted therein. The pump housing 14 comprises an outer section 20 formd therein with a suction port 18 and constituting an end wall of the casing 11 of the pump apparatus 10 and an inner section 22 secured to the outer section 20.

The inner section 22 of the pump housing 14 also acts as a holder for supporting a bearing 26 for the motor 13. The motor has a shaft 28 extending through the bearing 26 and having an outer end extending into a recess 30 formed in the central area of the inner surface of the outer section 20 of the pump housing 14.

The impeller 16 is mounted on the shaft for rotation therewith and for axial sliding movement thereon. The shaft 28 carries thereon a transverse pin 32 which transmits the toreque of the shaft 28 and thus of the motor 13 to the impeller 16. The impeller is provided with circumferential rows of circumferentially spaced radial vane grooves 34 formed in the opposite end faces of the impeller adjacent to the outer periphery thereof so that the vane grooves operate to pump the fluid. The grooved outer marginal section of the impeller 16 and the pump housing 14 cooperate together to define a circumferential fluid passage 36 which is communicated not only with the suction port 18 but also with a discharge port 38 formed in the inner section 22 of the pump housing. As will be seen in FIG. 2, the suction and discharge ports 18 and 38 are spaced circumferentially of the impeller 16. The pump housing inner section 22 has an integral portion 40 which extends into the circumferential fluid passage 36 between the suction and discharge ports 18 and 38 to form a circumferential partition, as will be seen in FIG. 2. In other words, the circumferential fluid passage 36 is circumferentially interrupted by the partition 40.

The pump 12 is of the type that is so-called "regenerative pump" which is designed to produce such a high dischage pressure as is required for a fuel pump used in an electronically controlled fuel injection system. For this purpose, the pump 12 is provided with first set of sealing sections 42 and 44 formed between the opposite end faces of the impeller 16 and the adjacent inner surfaces of the pump housing 14. The sealing sections are disposed between the grooved outer marginal section of the impeller 16 and the central area thereof. The clearance or gaps between the impeller end faces and the pump housing at the sealing sections 42 and 44 are usually as small as from 30 to 60 microns but are exaggerated in the drawings.

In addition to the first set of sealing sections 42 and 44, the pump apparatus 10 is provided with a second set of sealing sections 46 and 48 disposed radially inwardly of the first set of sealing sections 42 and 44 and, more specifically, adjacent to the central area of the impeller 16. The second set of sealing sections 46 and 48 are intended to be operative to control the clearances between the impeller and the pump housing inner sufaces at the first set of sealing sections 42 and 44 as well as to prevent the impeller from being unduly shifted in one axial direction and being damaged at the grooved outer marginal section. For this purpose, the clearances between the impeller 16 and the housing inner surfaces at the second set of sealing sections 46 and 48 are smaller than those at the first set of sealing sections 42 and 44, namley, less than 30 microns. In the embodiment of the invention illustrated in FIG. 1 of the drawings, the second set of sealing sections 46 and 48 are formed by the cooperation of the inner surfaces of the pump housing directed to the impeller end faces and annular projections 50 and 52 formed on the opposite end faces of the impeller between the first set of sealing sections 42 and 44 and the central section of the impeller.

The circumferential partition 40 forms a third sealing section 41 providing a seal between the pump housing and the grooved marginal section of the impeller and between the suction and discharge ports 18 and 38.

The impeller 16 is provided with a plurality of axial communiction passages 54 constituted by grooves formed in the inner peipheral surface of the shaft hole in the impeller so that the fluid pressures on both sides of the impeller, namely, the fluid pressure in the recess 30 and the fluid pressure in the space 56 defined between the bearing 26 and the impeller 16, are balanced or equalized. Due to the pressure-equalizing function of the communication passages 54, the clearances between the impeller 16 and the housing inner surfaces at the second set of sealing sections 46 and 48 are substantially equalized to facilitate smooth rotation of the impeller.

With respect to the motor 13, it has been described that the impeller 16 of the pump 12 is mounted on one end of the shaft 28. The other end of the shaft 28 is journalled by a second bearing 60 which in turn is mounted by a rocking washer 64 on the other end wall 62 of the casing 11 (it has been described that one end of the casing is formed by the outer section 20 of the pump housing 14). The end wall 62 forms a bearing holder and is fitted into the end of the pump casing 11 remote from the pump 12. Permanent magnets 70 are secured to the inner peipheral surface of the casing 11 by any conventional securing means. An armature 72 is mounted on the shaft 28 and aligned with the magnets 70. A commutator 7-4 is mounted on the shaft 28 adjacent to the armature 72. A brush 76 is mounted by a brush holder 78 on the bearing holder 62. A fuel delivery port 80 is formed centrally of the bearing holder 62 while fuel discharge passages 82 are formed in the end wall or bearing holder 62 around the bearing 60 to provide communication between the fuel delivery port 80 and the space within the motor 13.

The fuel pump 10 of the construction and arrangement described is usually installed in a fuel tank of a vehicle.

In operation, when the brush 76 is supplied with an electric current, the armature 74 is rotated with the shaft 28 and the impeller 16, so that fuel is sucked through the suction port 18 into the circumferential fluid passage 36 and pressurized to a pressure level of from about 3 to about 4 $kg/cm^2$ and then discharged through the discharge port 38 into the space within the motor 13. The fuel then flows through the space between the armature 72 and the magnets 70 while cooling the armature and is then discharged through the discharge passages 82 and the delivery port 80 into a conduit (not shown) connected to the port 80 so that the pressurized fuel is fed to fuel injectors (not shown) mounted on an engine.

Figure 3:
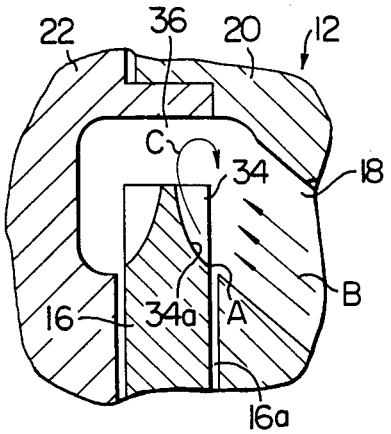
FIG. 3 is an enlareged fragmentary sectional view of the pump showing tangential orientation of a suction port of the pump relative to the bottom surface of a radial vane groove in the impeller.

In the pump 12 of the pump apparatus 10 having the described structure and function, each of the vane grooves 34 is open partly in an associated end face of the impeller 16 and in the outer peripheral surface thereof and having a bottom face **34*a* which is substantially arcuate as viewd in a radial section of the impeller 16 and extends between the said associated end face of the impeller and the outer peripheral surface thereof, as best shown in FIG. 3. The suction port 18 is oriented such that, at the junction A between the impeller end face adjacent to the suction port 18 and the arcuate bottom face 34*a* of each of the vane grooves 34 in this impeller end face, the suction port 18 is substantially tangential to the arcuate vane bottom face 34*a*, as clearly shown in FIG. 3. This tangential orientation of the suction port 18 advantageously assure that the stream B of the fuel through the port 18 into the circumferential fluid passage 36 is smoothly guided by the arcuate bottom faces 34*a* of respective vane grooves 34 in a manner shown by arrow C in FIG. 3 whereby the fluid flow through the suction port 18 is smoothly introduced into the passage 36 without disturbing swirls produced within the passage 36**. This reduces the resistance of the pump to the incoming fluid flow, prevents the occurrence of cavitation and improves the pump performance.

Figure 4:
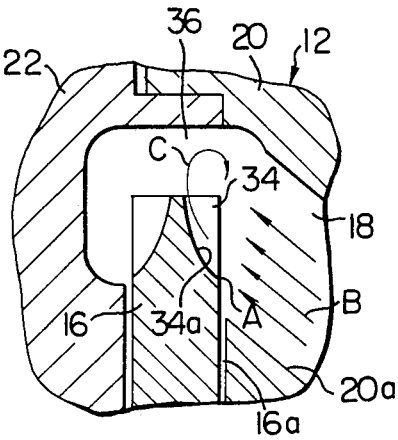
FIG. 4 is a view similar to FIG. 3 but shows a modifiction of the arrangement shown in FIG. 3.

In the embodiment shown in FIG. 3, the radially inner side of the opening of the suction port 18 to the circumferential passage 36 is substantially radially aligned to the junction A. This alignment, however, is not essential to the invention. Indeed, the applicants have verified that advantageous result similar to one obtained from the arrangement shown in FIG. 3 can also be obtained from a modified arrangement shown in FIG. 4 in which the radially inner surface 20*a* of the suction port 18 is substantially parallel to the tangent to the arcuate bottom face 34*a* of each vane groove 34 at the junction A and the inner side of the opening of the suction port 18 to the circumferential fluid passage 36 is slightly radially inwardly offset from the junction A.

The pump apparatus 10 has been described as being an electrically operated fuel pump. However, the invention is not limited to an electrically operated fuel pump.

What is claimed is:

1. In pump apparatus comprising:

a pump means;

means drivingly connected to said pump means to drive the same;

said pump means comprising a closed vane type regenerative pump and including a pump housing and an impeller rotatably housed in said pump housing;

said impeller having a substantially disc-like shape and being provided with first and second circumferential rows each formed by a plurality of circumferentially spaced radial vane grooves fromed in each of the end faces of said impeller adjacent to the outer peripheral surface of said impeller;

said pump housing cooperating with said impeller to define a circumferential fluid passage surrounding said circumferential rows of van grooves;

said pump housing being formed therein with suction and discharge ports spaced circumferentially of said impeller and communicated with said circumferential fluid passage, said suction port being disposed adajcent to said first row of vane grooves;

means disposed in said circumferential fluid passage between said suction and discharge ports to provide a circumferential seal therebetween;

each of said vane grooves being open partly in an associated end face of said impeller and partly in said outer peripheral surface of said impeller and having a bottom face which is substantially arcuate as viewed in a radial section of said impeller and extends between said associated end face of said impeller and said outer peripheral surface thereof; characterized is that:

said suction port has an inner end open to said circumferential fluid passage adjacent to one of the end faces of said impeller and is substantially tangential to said acruate bottom face of each of the vane grooves of said first row at the junction between said arcuate vane groove bottom face and said one end face of said impeller.

2. A pump apparatus according to claim 1, wherein the radially inner side of said opening of said suction port to said circumferential fluid passage is substantially radially aligned to said junction.

3. A pump apparatus according to claim 1, wherein the radially inner side of said opening of said suction port to said circumferential fluid passage is radially inwardly offset from said junction.

4. A pump appartus according to claim 1, 2 or 3, wherein said discharge port has an inner end open to said circumferential fluid passage adjacent to the other end face of said impeller.

5. A pump apparatus according to claim 1, 2 or 3 wherein said pump housing includes an integral portion extending into said circumferential fluid passage to provide said circumferential seal.

6. In pump apparatus comprising:

a pump means;

means drivingly connected to said pump means to drive the same;

said pump means comprising a clsoed vane type regenerative pump and including a pump housing and an impeller rotatably housed in said pump housing;

said impeller having a substantially disc-like shape and being provided with first and second circumferential rows each formed by a plurality of circumferentially spaced radial vane grooves fromed in each of the end faces of said impeller adjacent to the outer peripheral surface of said impeller;

said pump housing cooperating with said impeller to define a circumferential fluid passage surrounding said circumferential rows of vane grooves;

said pump housing being formed therein with suction and discharge ports spaced circumferentially of said impeller and coimunicated with said circumferential fluid passage, said suction port being disposed adjacent to said first row of vane grooves;

means disposed in said circumferential fluid passage between said suction and discharge ports to provide a circumferential seal therebetween;

each of said vane grooves being open partly in an associated end face of said impeller and partly in said outer peripheral surface of said impeller and having a bottom face which is substantially arcuate as viewed in a radial section of said impeller and extends between said associated end face of said impeller and said outer peripheral surface thereof; characterized in that:

said suction port has an inner end open to said circumferential fluid passage adjacent to one of the end faces of said impeller and also has a radially inner surface substantailly parallel to a tangent to said acruate bottom face of each of the vane grooves of said first row at the junction between said arcuate vane groove bottom face and said one end face of said impeller, said inner surface being radially inwardly offset from said junction.

* * * * *